US008811625B2

(12) United States Patent
Yao

(10) Patent No.: US 8,811,625 B2
(45) Date of Patent: Aug. 19, 2014

(54) HEADPHONE SYSTEM, PORTABLE ELECTRONIC DEVICE AND AUDIO OUTPUT SWITCHING METHOD

(75) Inventor: Xu-Hong Yao, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 259 days.

(21) Appl. No.: 13/236,619

(22) Filed: Sep. 19, 2011

(65) Prior Publication Data

US 2012/0128170 A1 May 24, 2012

(30) Foreign Application Priority Data

Nov. 19, 2010 (CN) ..... 2010 1 0550841

(51) Int. Cl.
*H04R 1/10* (2006.01)

(52) U.S. Cl.
CPC ..... *H04R 1/1033* (2013.01); *H04R 2499/15* (2013.01); *H04R 1/1041* (2013.01)
USPC ..... 381/74; 381/81; 381/85; 381/61; 381/123

(58) Field of Classification Search
CPC .... H04R 1/1041; H04R 1/1033; H04R 5/033; H04R 5/0335; H04R 2420/01; H04R 2420/03; H04R 2420/05; H04R 1/1008; H04R 1/1016; H04R 5/04; H04R 1/105; H04R 5/02; H04R 2499/15; H04R 2499/13; G06F 3/165; G06F 1/1605; H04N 5/642; H04S 1/002; H04M 1/6058; H04M 1/6066
USPC ..... 381/74, 78, 79, 81, 85, 86, 302, 28, 61, 381/63, 120, 123, 306; 455/569.2, 574, 455/575.9, 575.2; 700/94
See application file for complete search history.

(56) References Cited

U.S. PATENT DOCUMENTS

| | | | | |
|---|---|---|---|---|
| 5,491,507 | A | 2/1996 | Umezawa | |
| 5,724,667 | A | 3/1998 | Furuno | |
| 6,301,487 | B1 * | 10/2001 | Nakamura | 455/550.1 |
| 2004/0136552 | A1 * | 7/2004 | Bendixen et al. | 381/306 |

FOREIGN PATENT DOCUMENTS

| | | | |
|---|---|---|---|
| CN | 2494084 | Y | 5/2002 |
| CN | 1426753 | A | 7/2003 |
| CN | 201323643 | Y | 10/2009 |
| TW | 200419133 | | 10/2004 |
| TW | M254585 | | 1/2005 |

OTHER PUBLICATIONS

Office action mailed on Nov. 13, 2013 for the Taiwan application No. 099140182, filing date: Nov. 22, 2010, p. 2 line 2~20 and line 23~25, p. 3 line 1~13 and line 16~22 and p. 4 line 2~10.
Office action mailed on Dec. 4, 2013 for the China application No. 201010550841.1, p. 4 line 4~14, line 24~30 and line 32 and p. 5 line 1~6.
Office action mailed on May 6, 2014 for the China application No. 201010550841.1, p. 3 line 5~14.

* cited by examiner

*Primary Examiner* — Leshui Zhang
(74) *Attorney, Agent, or Firm* — Winston Hsu; Scott Margo

(57) ABSTRACT

A headphone system, installed in a portable electronic device for outputting sounds, includes an audio wire for transmitting audio signals, a sound output device for receiving and demonstrating the audio signals transmitted by the audio wire, an audio processing unit for receiving audio data and outputting the audio signals corresponding to the audio data via the audio wire according to a control signal, an automatic reel wound around by the audio wire for rolling up the audio wire, a length detection unit for detecting a rotating distance and a rotating direction of the automatic reel, and a control unit for outputting the control signal to the audio processing unit according to a detection result of the length detection unit, to control operations of the audio processing unit.

10 Claims, 13 Drawing Sheets

HEADPHONE SYSTEM, PORTABLE ELECTRONIC DEVICE AND AUDIO OUTPUT SWITCHING METHOD

BACKGROUND OF THE INVENTION

1. Field of the Invention

The present invention relates to a headphone system, portable electronic device and audio output switching method, and more particularly, to a headphone system, portable electronic device and audio output switching method capable of enhancing packing performance and convenience.

2. Description of the Prior Art

With development of technology and progress of industry, opportunities of using portable electronic devices including laptop, tablet computer, electronic book, smartphone, and portable video player in daily life largely increase, and multimedia functions are emphasized as well. For outputting sounds, other than a speaker, a portable electronic device is generally equipped with a headphone jack, to connect an external headphone, so as to output sounds through the headphone.

Since the headphone is connected to the portable electronic device externally, a user encounters a problem of packing the headphone, and may not find the headphone when needed. In this situation, how to facilitate the use of the headphone becomes a goal of the industry.

SUMMARY OF THE INVENTION

It is therefore the main objective of the present invention to provide a headphone system, portable electronic device and audio output switching method.

The present invention discloses a headphone system, installed in a portable electronic device for outputting sounds. The headphone system includes an audio wire for transmitting audio signals, a sound output device, for receiving and demonstrating the audio signals transmitted by the audio wire, an audio processing unit, for receiving audio data and outputting the audio signals corresponding to the audio data via the audio wire according to a control signal, an automatic reel, wound around by the audio wire for rolling up the audio wire, a length detection unit, for detecting a rotating distance and a rotating direction of the automatic reel, and a control unit, for outputting the control signal to the audio processing unit according to a detection result of the length detection unit, to control operations of the audio processing unit.

The present invention further discloses a portable electronic device, which includes an operating circuit and a headphone system, for outputting sounds. The headphone system includes an audio wire, for transmitting audio signals, a sound output device, for receiving and demonstrating audio signals transmitted by the audio wire, an audio processing unit, for receiving audio data outputted by the operating circuit and outputting the audio signals corresponding to the audio data via the audio wire according to a control signal, an automatic reel, wound around by the audio wire for rolling up the audio wire, a length detection unit, for detecting a rotating distance and a rotating direction of the automatic reel, and a control unit, for outputting the control signal to the audio processing unit according to a detection result of the length detection unit to control operations of the audio processing unit.

The present invention further discloses an audio output switching method for a portable electronic device, which includes a headphone system capable of rolling up an audio wire of the headphone system into the portable electronic device. The audio output switching method includes detecting a length of the audio wire pulled out from the headphone system, and turning on the headphone system when a distance of the audio wire pulled out from headphone system is larger than a predefined value.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
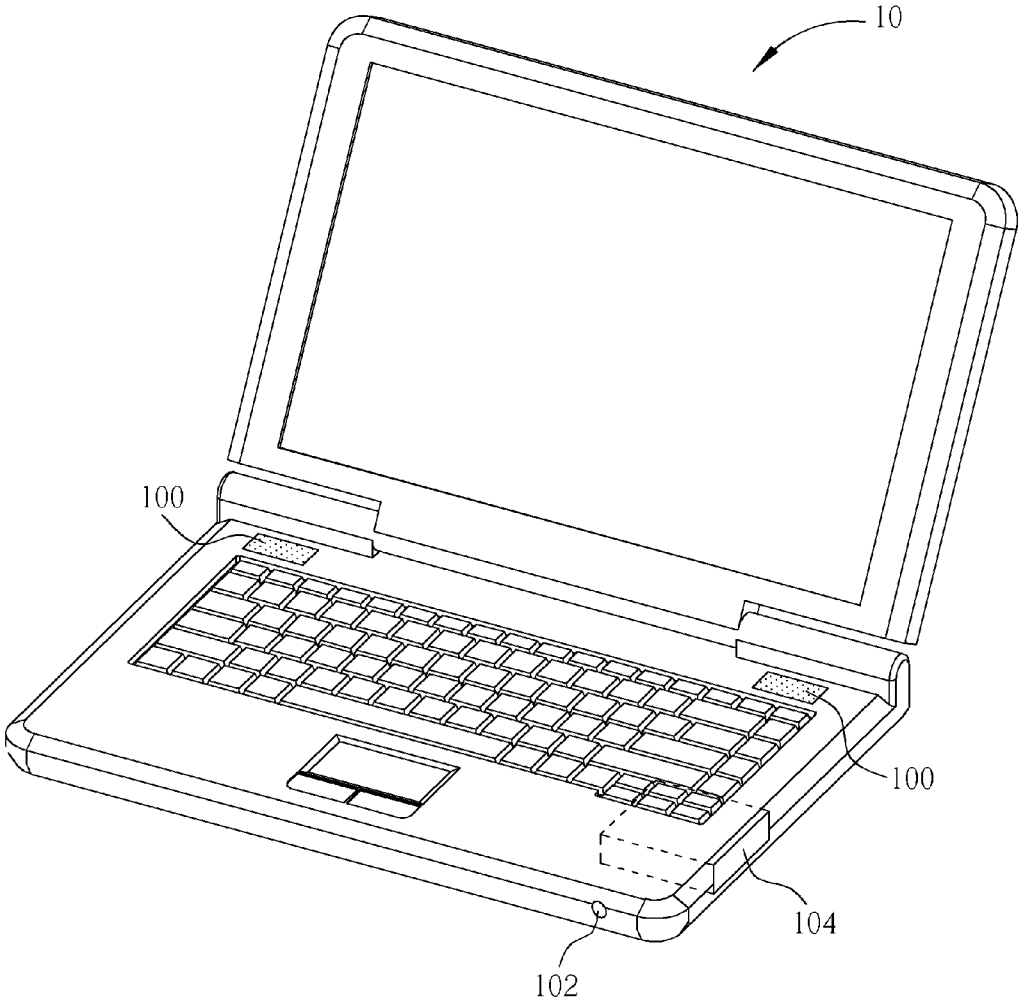
FIG. 1 is a schematic diagram of a laptop according to an embodiment of the present invention.

Please refer to FIG. 1, which is a schematic diagram of a laptop 10. The laptop 10 uses a speaker 100 and a headphone jack 102 for outputting sounds. In addition, the laptop 10 can further outputs sounds via a headphone system 104. The headphone system 104 is installed in the laptop 10, and can be packed into a housing of the laptop 10, and can automatically switch an enabling state. Noticeably, the laptop 10 shown in FIG. 1 is used to illustrate an application status of the headphone system 104. In practice, other portable electronic devices capable of outputting sounds, such as tablet computer, electronic book, smartphone, portable video player, etc., can be equipped with the headphone system 104.

Figure 2A:
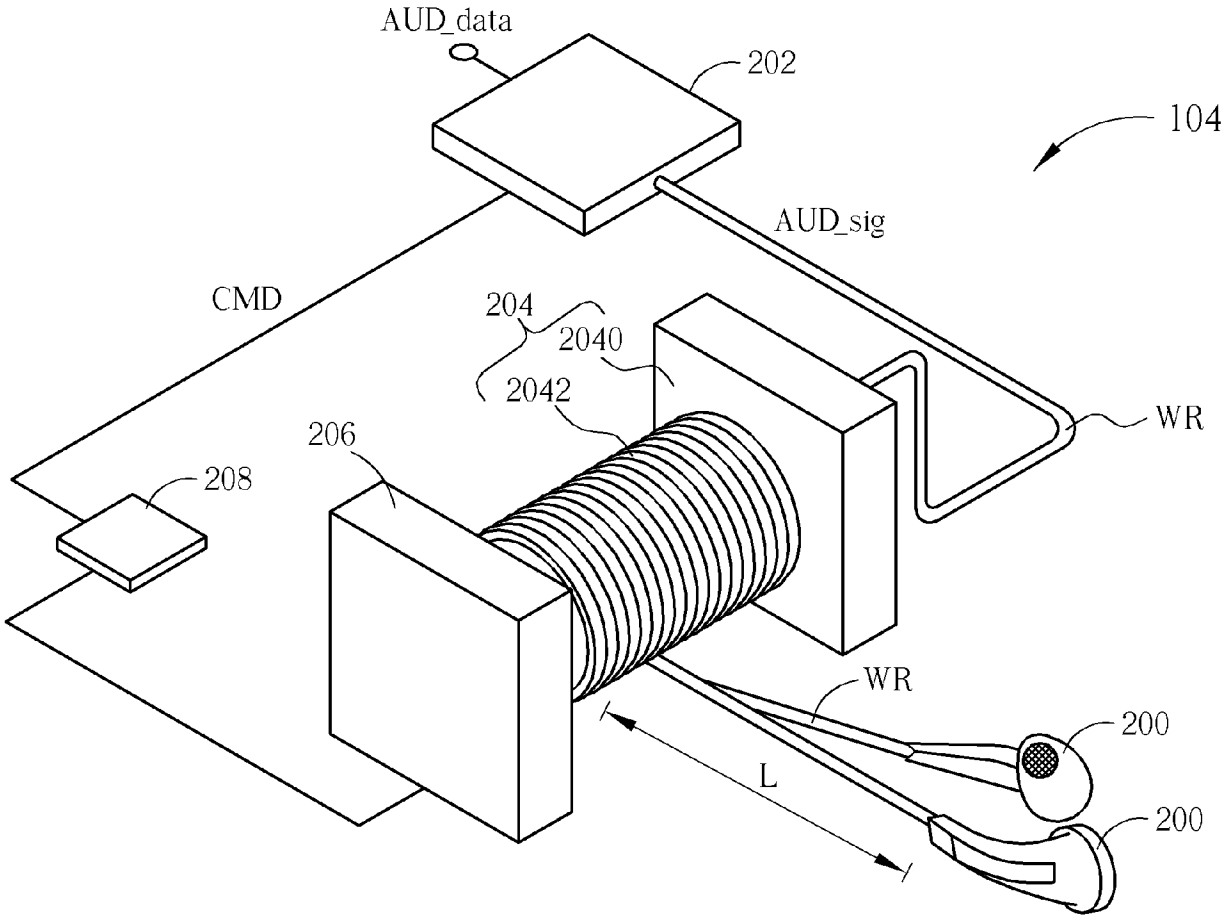
FIG. 2A is a schematic diagram of a structure of a headphone system shown in FIG. 1.
Figure 2B:
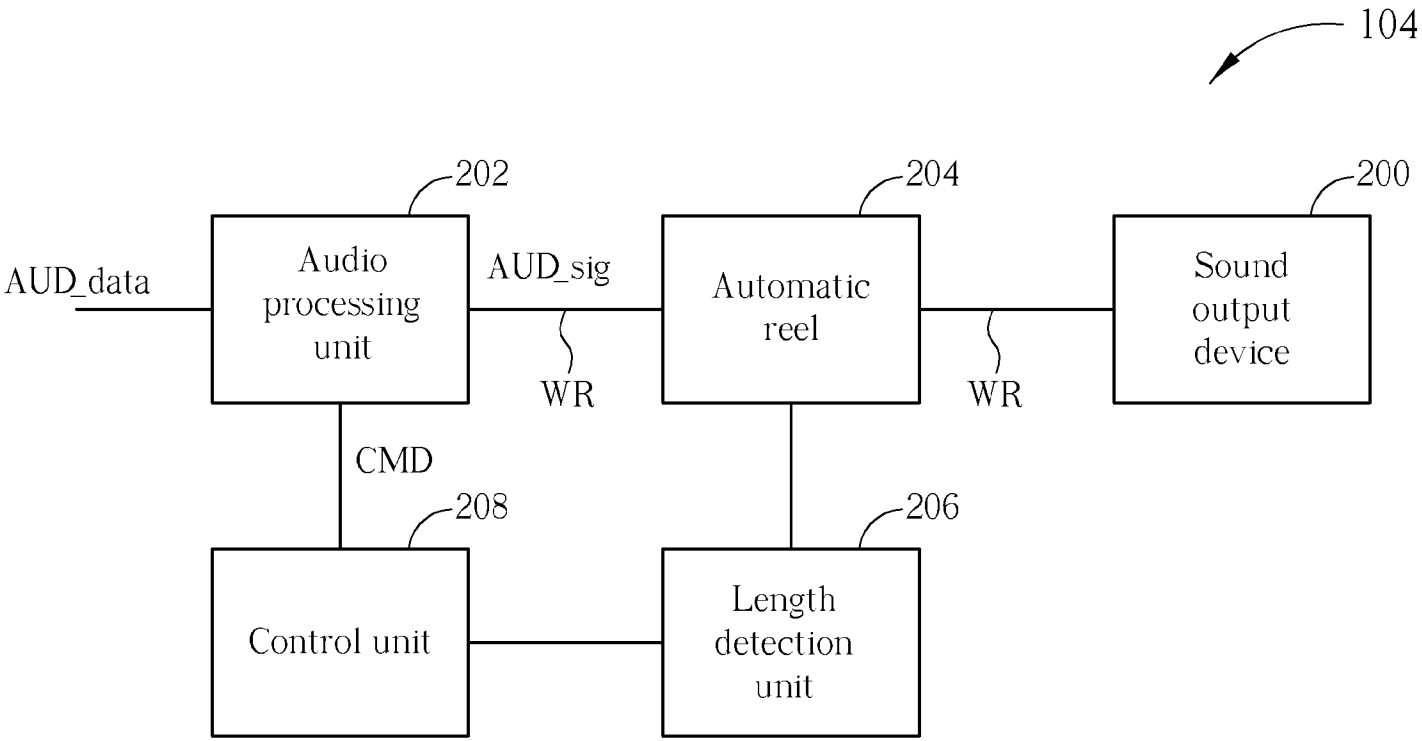
FIG. 2B is a functional block diagram of the headphone system shown in FIG. 2A.

In detail, please continue to refer to FIG. 2A and FIG. 2B. FIG. 2A is a schematic diagram of the headphone system 104 shown in FIG. 1, and FIG. 2B is a functional block diagram of the headphone system 104. As shown in FIG. 2A and FIG. 2B, the headphone system 104 includes an audio wire WR, a sound output device 200, an audio processing unit 202, an automatic reel 204, a length detection unit 206, and a control unit 208. The automatic reel 204 is composed of an elastic structure 2040 and an axis 2042. The axis 2042 is wound around by parts of the audio wire WR, and the elastic structure 2040 can drive the axis 2042 to rotate, so as to roll up the audio wire WR automatically. Preferably, the automatic reel 204 can include a button for fixing and locking the elastic structure 2040, and triggering the elastic structure 2040 to roll up the audio wire WR automatically when the button is pressed. The length detection unit 206 and the axis 2042 of the automatic reel 204 moves synchronously, in order to detect a length L of the audio wire WR pulled out. When the length L detected by the length detection unit 206 is greater than a predefined value L_TH, the control unit 208 controls the audio processing unit 202 to start operating via a control signal CMD. Then, the audio processing unit 202 transforms audio data AUD_data outputted by an operating circuit (not shown in FIG. 2A and FIG. 2B) of the laptop 10 to audio signals AUD_sig, which is outputted to the sound output device 200 through the audio wire WR, thereby demonstrating corresponding audio contents through the sound output device 200. Oppositely, when the length L is smaller than the predefined value L_TH, the control unit 208 controls the audio processing unit 202 to stop operating. In other words, the sound output device 200 does not output sounds.

In short, when the headphone system 104 is not used, a user can pack the audio wire WR and the sound output device 200 into the housing of the laptop 10 through the automatic reel 204. When the user intends to listen to audio contents through the headphone system 104, the user can pull out the sound output device 200 from the housing of the laptop 10. Then, the audio wire WR drives the axis 2042 of the automatic reel 204 to rotate toward a specific direction (taking FIG. 2A as an example, wherein the specific direction is a clockwise direction), and the length detection unit 206 can detect the length L and the direction of the audio wire WR pulled out at the same time. When the length L of the audio wire WR pulled out is greater than the predefined value L_TH, the control unit 208 controls the audio processing unit 202 to start operating, so as to demonstrate corresponding audio contents through the sound output device 200.

Therefore, the headphone system 104 can be packed into the laptop 10 and can switch the enabling state automatically. Noticeably, the headphone system 104 shown in FIG. 2A and FIG. 2B is used to illustrate the concept of the prevent invention, and those skilled in the art should readily make modifications or alterations accordingly. For example, the automatic reel 204 shown in FIG. 2A and FIG. 2B is only a structure well-known by those skilled in the art (e.g. broadly used for implementing a reel of a vacuum cleaner), and is not limited herein.

Figure 3A:
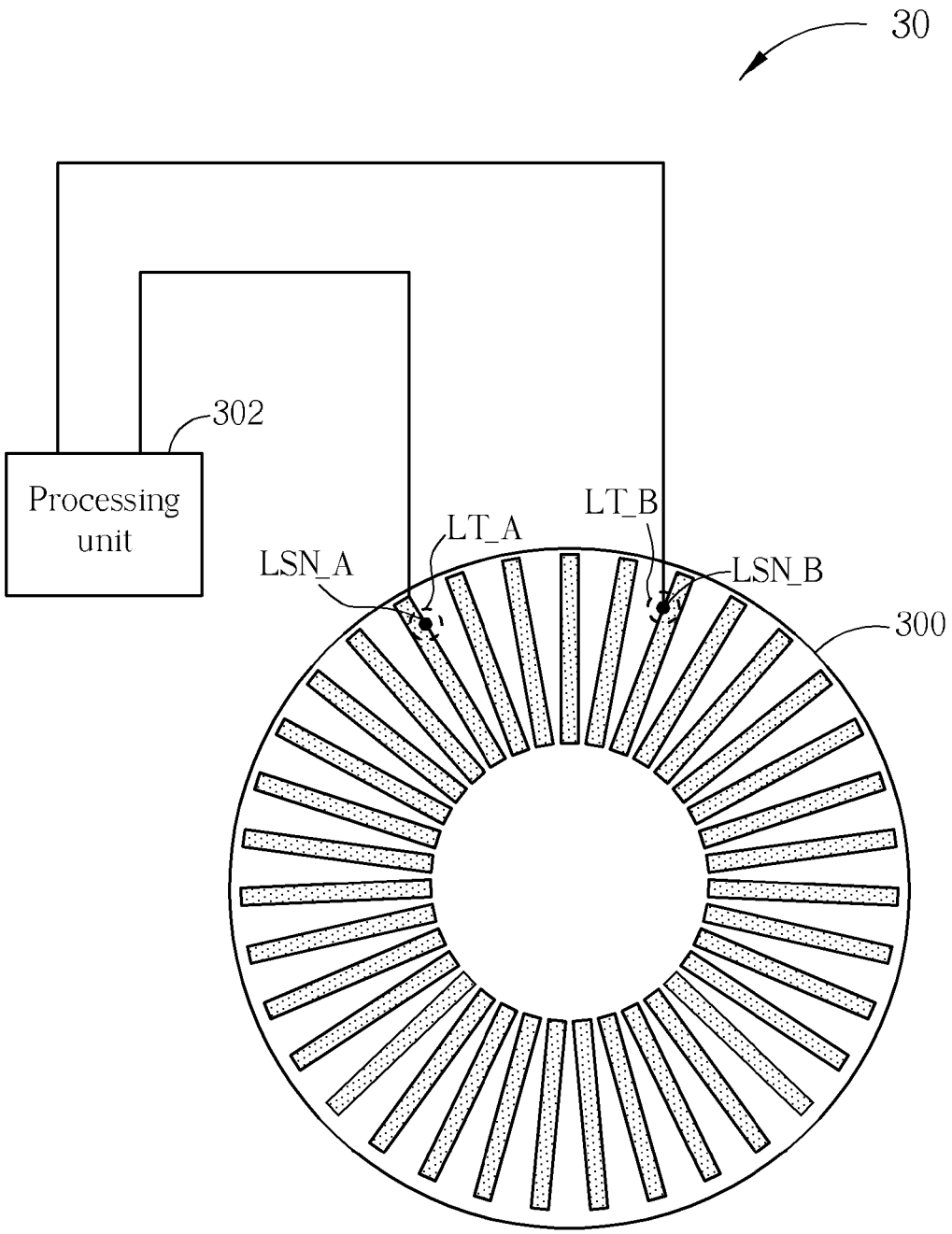
FIG. 3A is a schematic diagram of a raster-type detector.

Moreover, the main objective of the length detection unit 206 is to detect the length L and direction of the audio wire WR pulled out, and the structure with which the length detection unit 206 is implemented with is not limited. For example, FIG. 3A is a schematic diagram of a raster-type detector 30, which is utilized to implement the length detection unit 206, composed of a circular raster set 300, light sources LT_A, LT_B, light detectors LSN_A, LSN_B, and a processing unit 302. The circular raster set 300 and the axis 2042 of the automatic reel 204 act synchronously. The light sources LT_A and LT_B are installed at one side of the circular raster set 300, and the light detectors LSN_A and LSN_B are installed at another side of the circular raster set 300. When the circular raster set 300 rotates as the axis 2042 rotates, the detectors LSN_A and LSN_B can detect brightness variation generated by the light sources LT_A and LT_B through the circular raster set 300, whereby the processing unit 302 can determine a rotating distance and a rotating direction of the axis 2042 by detection results of the light detectors LSN_A and LSN_B, so as to determine the length L.

Figure 3B:
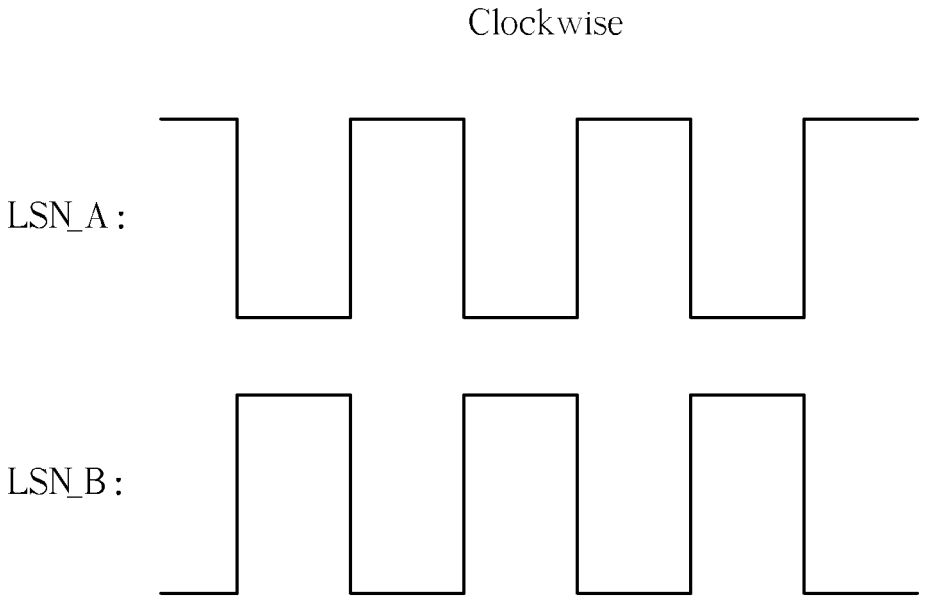
FIG. 3B is a schematic diagram of a detection result generated by the raster-type detector shown in FIG. 3A when detecting clockwise rotation.
Figure 3C:
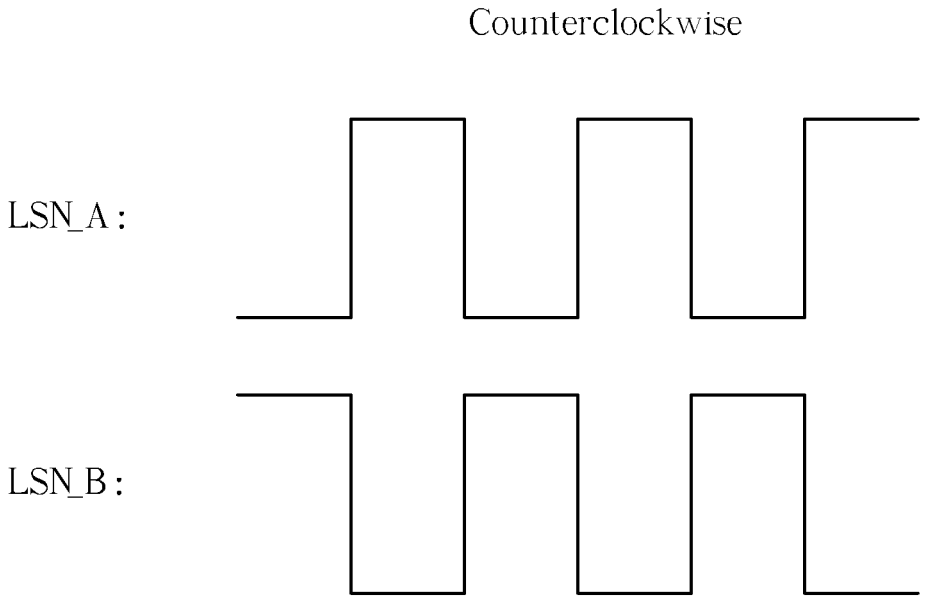
FIG. 3C is a schematic diagram of a detection result generated by the raster-type detector shown in FIG. 3A when detecting counterclockwise rotation.

In detail, the light source LT_A and the light detector LSN_A are installed face to face. Similarly, the light source LT_B and the light detector LSN_B are also installed face to face. Besides, as shown in FIG. 3A, the light source LT_A (or the light detector LSN_A) and the light source LT_B (or the light detector LSN_B) are installed at different sides of two rasters. For example, the light source LT_A is installed at left side of a raster, and the light source LT_B is installed at right side of another raster. In such a situation, if the axis 2042 rotates clockwise, the detection results of the light detectors LSN_A and LSN_B can be illustrated by FIG. 3B. If the axis 2042 rotates counterclockwise, the detection results of the light detectors LSN_A and LSN_B can be illustrated by FIG. 3C. Furthermore, the processing unit 302 can calculate the rotation distance (e.g. length L) of the axis 2042 according to the following equation:

$$L=2\pi\times r\times 2h/n,$$

where r is radius of the axis 2042, h is number of high impulse in the detection result of the light detector LSN_A or the light detector LSN_B, and n is the number of rasters in the circular raster set 300.

Figure 4A:
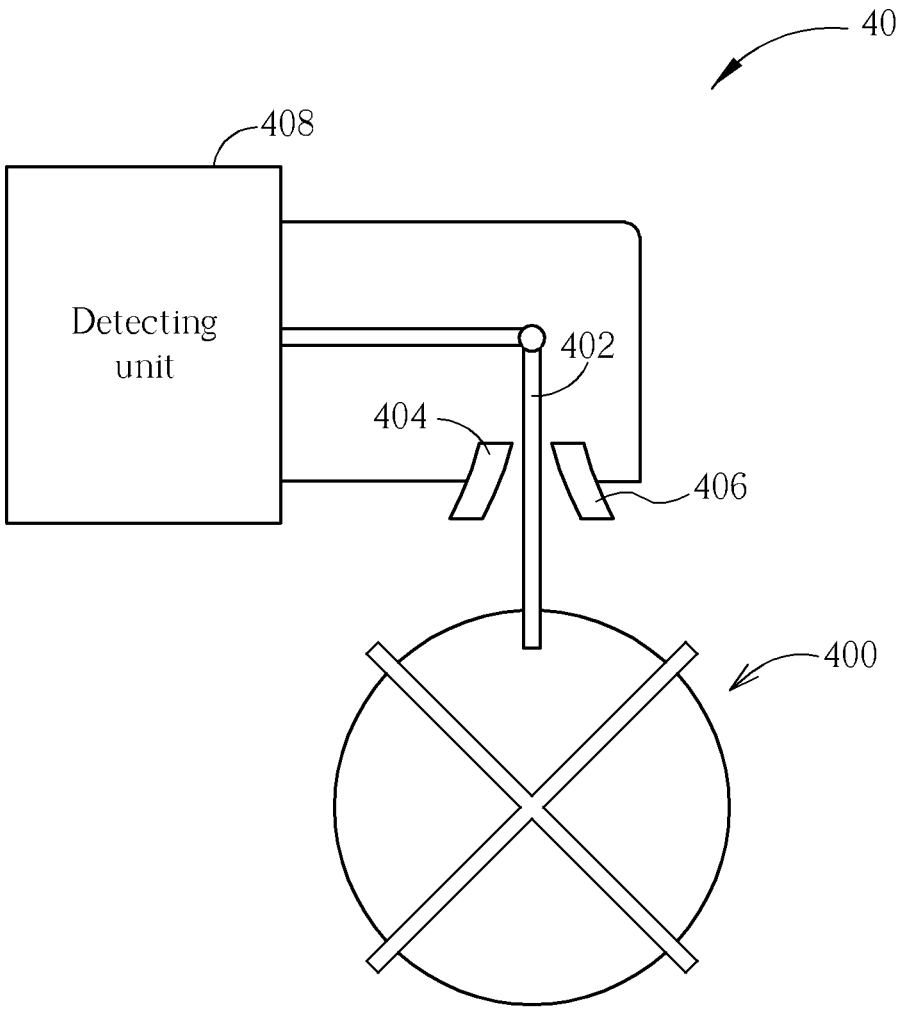
FIG. 4A is a schematic diagram of a trigger-type detector.
Figure 4B:
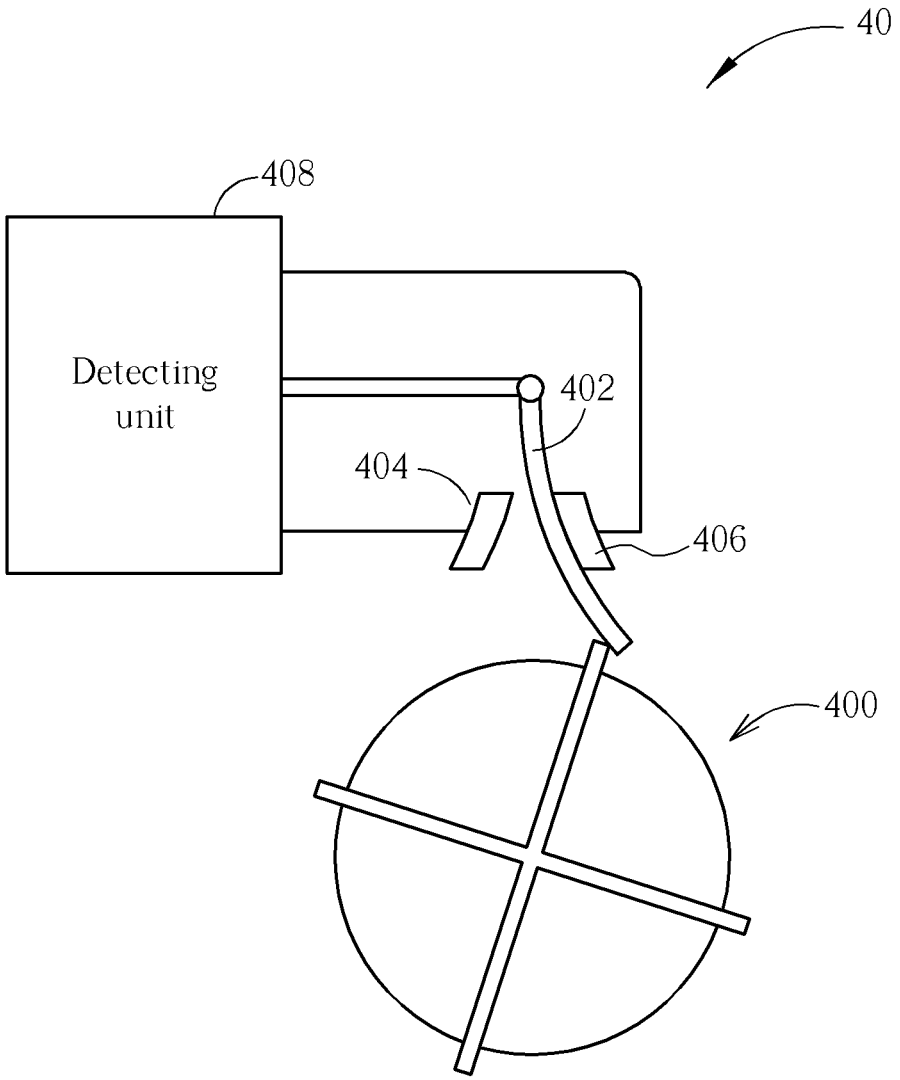
FIG. 4B is a schematic diagram of the trigger-type detector in FIG. 4A when detecting clockwise rotation.
Figure 4C:
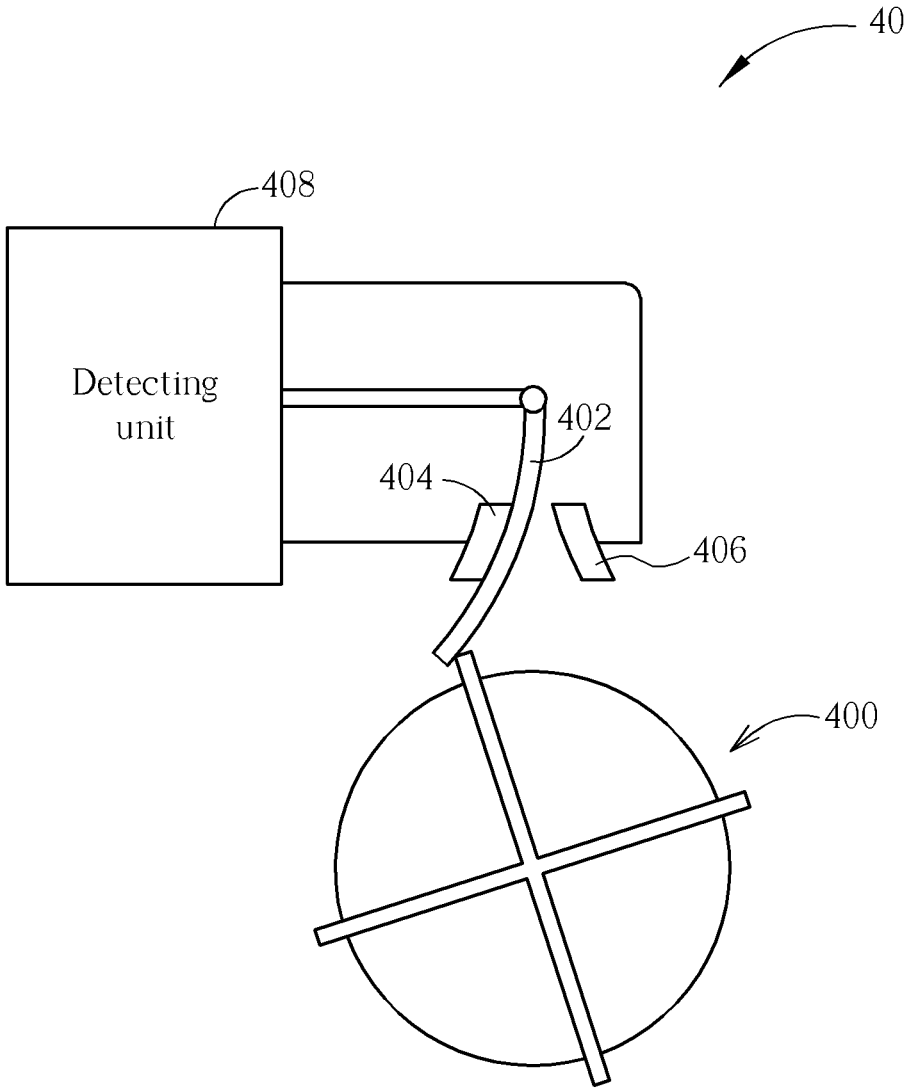
FIG. 4C is a schematic diagram of the trigger-type detector in FIG. 4A when detecting counterclockwise rotation.

Further, please refer to FIG. 4A, which is a schematic diagram of a trigger-type detector 40. The trigger-type detector 40 is used to realize the length detection unit 206, and is composed of a dial plate 400, a metal flexible plate 402, a metal bump 404, a metal bump 406, and a detecting unit 408. The dial plate 400 and the axis 2042 of the automatic reel 204 act synchronously. When the dial plate 400 rotates, the metal flexible plate 402 is turned to contact the metal bump 404 or the metal bump 406. Then, the detecting unit 408 can detect the rotating distance and direction of the axis 2042 according to an amount of contacts between the metal flexible plate 402 and the metal bump 404 or the metal bump 406. In detail, if the axis 2042 rotates clockwise, the dial plate 400 turns the metal flexible plate 402 deformed to contact the metal bump 406 as shown in FIG. 4B. If the axis 2042 rotates counterclockwise, the dial plate 400 turns the metal flexible plate 402 deformed to contact the metal bump 404 as shown in FIG. 4C. In this situation, each time the metal flexible plate 402 contacting the metal bump 404 (or the metal bump 406), it means that the axis 2042 rotates a quarter circle clockwise (or counterclockwise), whereby the detecting unit 408 can determine the rotating distance and the rotating direction of the axis 2042 according to contacting conditions between the metal flexible plate 402 and the metal bump 404 or the metal bump 406, so as to determine the length L.

Noticeably, the raster-type detector 30 shown in FIG. 3A and the trigger-type detector 40 shown in FIG. 4 are used to illustrate possible embodiments of the length detection unit 206, but are not limited herein. In practice, structures capable of detecting the rotating distance and direction of the axis 2042 can be used in the present invention, and those skilled in the art should readily make modifications or alterations accordingly. For example, in the raster-type detector 30, the number of light sources or light detectors is not limited to 2. And, in the trigger-type detector 40, the number of dial arms of the dial plate 400 is not limited to 4, and the dial plate 400 can be replaced by a gear.

On the other hand, in the headphone system 104, the control unit 208 is used to control operations of the audio processing unit 202. Besides, the control unit 208 can further control operations of the speaker 100 of the laptop 10. For example, when the length L of the audio wire WR pulled out is greater than the predefined value L_TH, other than controlling the audio processing unit 202 to start operation, the control unit 208 can further turn off the speaker 100. Oppositely, when the length L of the audio wire WR pulled out is smaller than the predefined value L_TH, other than controlling the audio processing unit 202 to stop operation, the control unit 208 can turn on the speaker 100. In this situation, when the user uses the headphone system 204 to receive audio contents, the laptop 10 can turn off the speaker 100 automatically, to avoid affect other people. When the user does not use the headphone system 204, the laptop 10 can turn on the speaker 100 automatically, to enhance convenience. Related operations are illustrated by FIG. 5A and FIG. 5B.

Figure 5A:
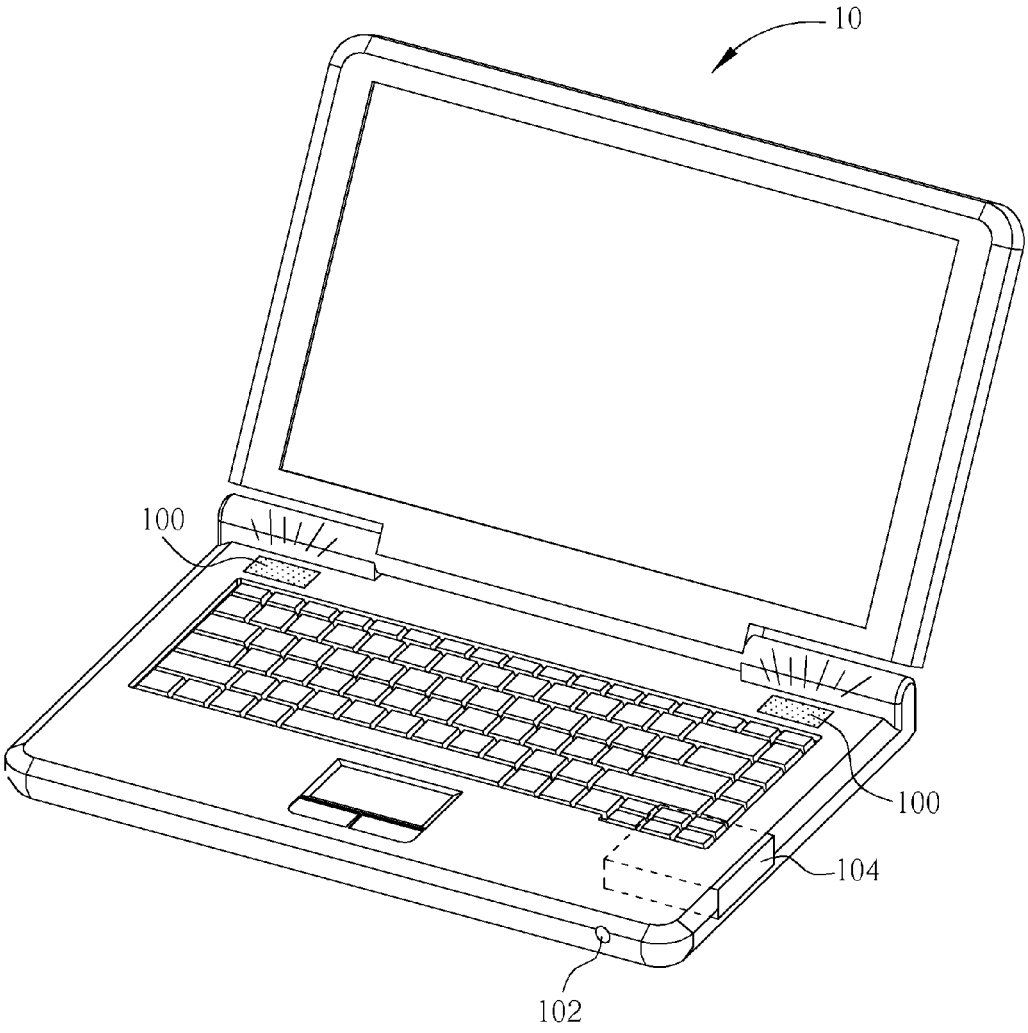
FIG. 5A is a schematic diagram of the laptop shown in FIG. 1 when a headphone system does not function.
Figure 5B:
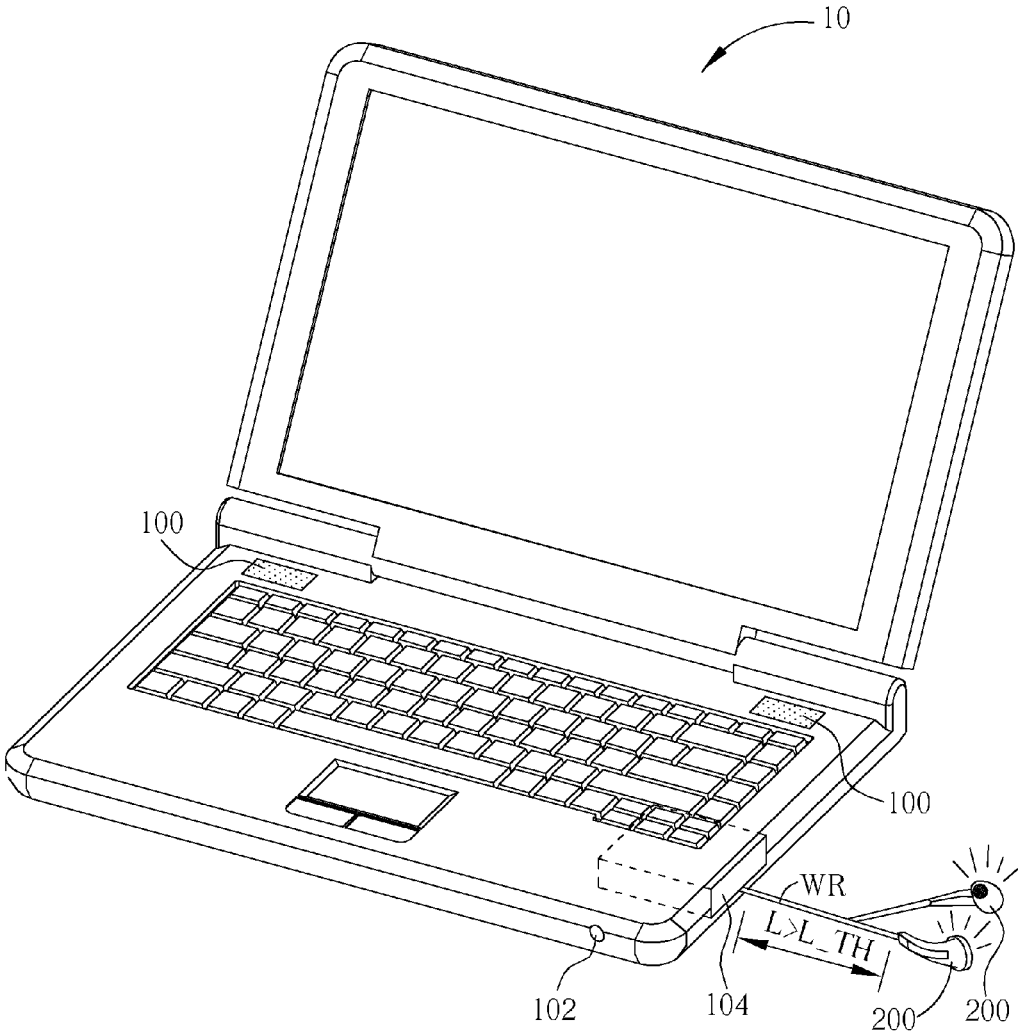
FIG. 5B is a schematic diagram of the laptop shown in FIG. 1 when a headphone system functions.
Figure 5C:
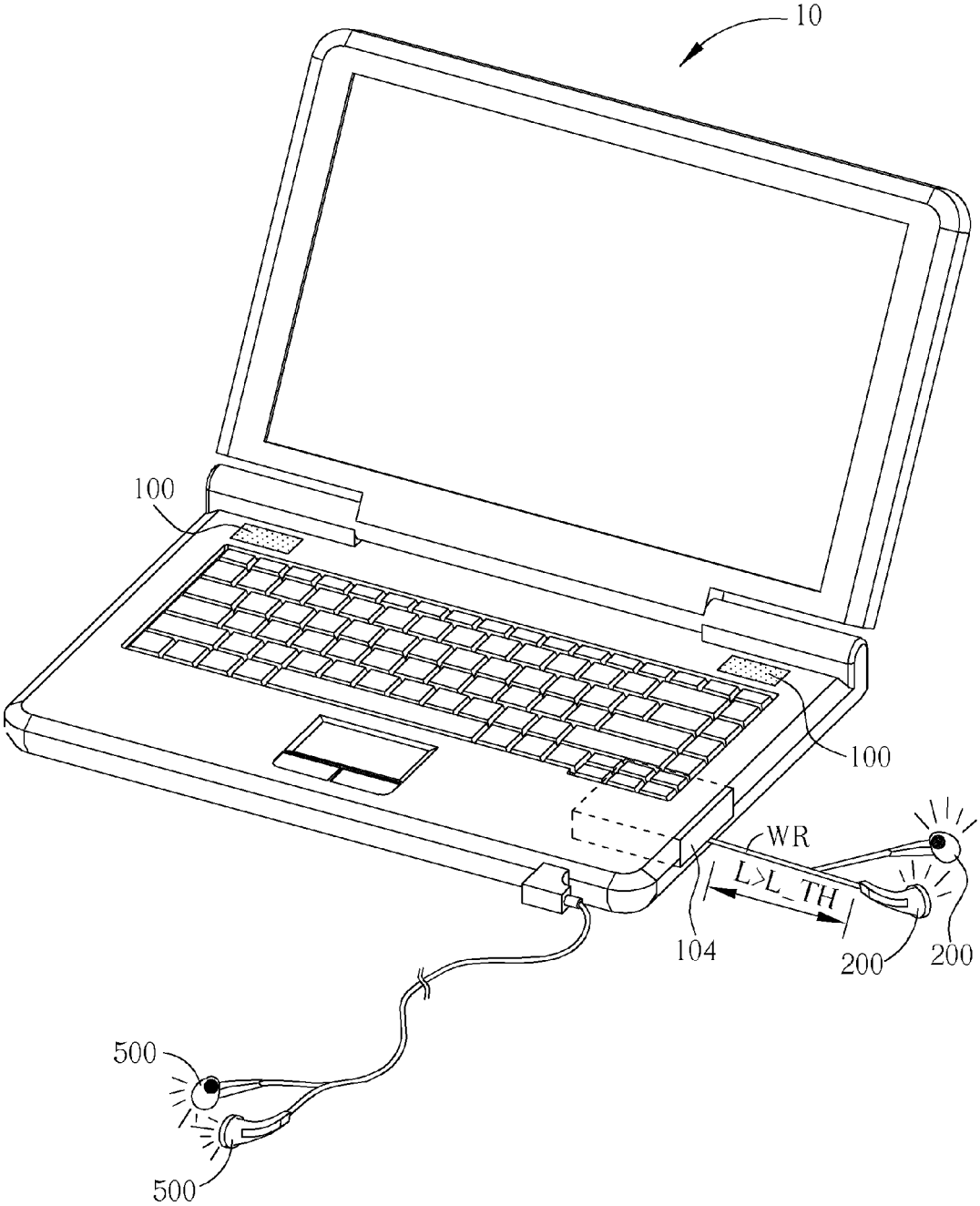
FIG. 5C is a schematic diagram of the laptop shown in FIG. 1 when a headphone system and a headphone jack function.

In FIG. 5A, the user does not use the headphone system 104, but receives audio contents through the speaker 100. Then, as shown in FIG. 5B, when the length L of the audio wire WR pulled out is greater than the predefined value L_TH, the laptop 10 turns off the speaker 100 automatically, and turn on the headphone system 104 at the same time. Furthermore, as shown in FIG. 5C, when the headphone system 104 is turned on, the user can connect a headphone 500 additionally to the headphone jack 102, to share audio contents with others. Noticeably, if the speaker 100 and the headphone jack 102 have a relating function (i.e., turning off the speaker 100 when the headphone jack 102 is connected to the headphone 500 externally), the function does not conflict with operations of the headphone system 104. In other words, when the headphone jack 102 is connected to the headphone 500 or the length L of the audio wire WR pulled out is greater than the predefined value L_TH, the laptop 10 turns off the speaker 100 automatically.

Figure 6:
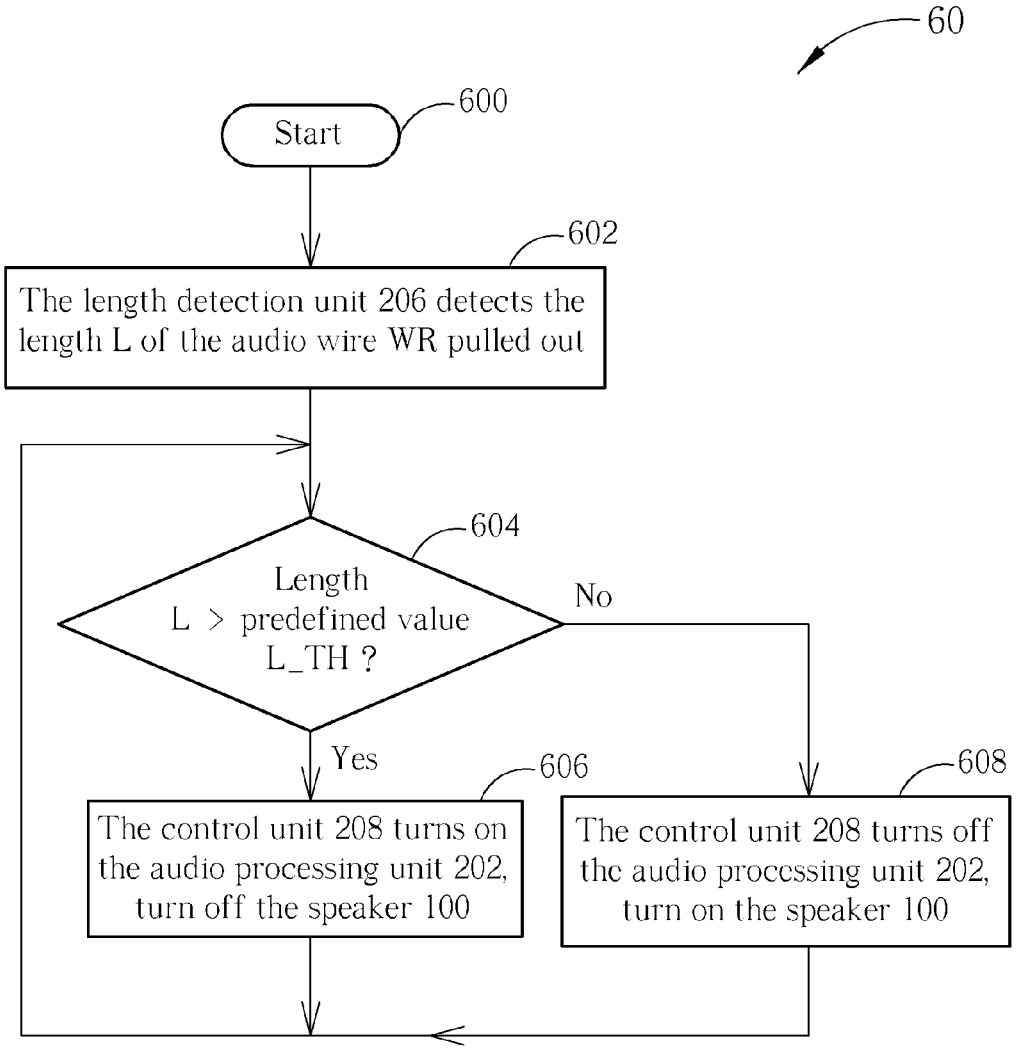
FIG. 6 is a schematic diagram of an audio output switching process according to an embodiment of the present invention.

Above operations about the headphone system 104 and the speaker 100 can be further summarized as an audio output switching process 60, as shown in FIG. 6. The audio output switching process 60 includes the following steps:

Step 600: Start.

Step 602: The length detection unit 206 detects the length L of the audio wire WR pulled out.

Step 604: The control unit 208 determines whether the length L is greater than the predefined value L_TH. If yes, perform step 606, otherwise, perform step 608.

Step 606: Turn on the audio processing unit 202, turn off the speaker 100, and go to step 604.

Step 608: Turn off the audio processing unit 202, turn on the speaker 100, and go to step 604.

The audio output switching process 60 illustrates operating status of the headphone system 104, and detailed description can be referred to the above.

In the prior art, since a headphone is connected to a portable electronic device externally, a user encounters a problem of packing headphone when the headphone is not needed, and may not find headphone when the headphone is needed. In comparison, in the present invention, the headphone system 104 can be packed into the laptop 10 and can switch the enabling state automatically, such that the convenience is significantly enhanced and disadvantages in the prior art are improved.

To sum up, the headphone system of the present invention can be packed into a portable electronic device, and can switch the enabling state automatically, such that packing efficiency and convenience are enhanced.

Those skilled in the art will readily observe that numerous modifications and alterations of the device and method may be made while retaining the teachings of the invention.

What is claimed is:

1. A headphone system installed in a portable electronic device configured to output sounds, comprising:

an audio wire, configured to transmit audio signals;

a sound output device, configured to receive and demonstrate the audio signals transmitted by the audio wire;

an audio processing unit, configured to receive audio data and output the transmitted audio signals corresponding to the received audio data via the audio wire according to a control signal;

an automatic reel, wound around an axis of the automatic reel by the audio wire and configured to roll up the audio wire around the axis of the automatic reel;

a length detection unit, configured to detect a rotating distance and a rotating direction of the automatic reel by synchronously rotating along the axis of the automatic reel when rolling up the audio wire; and a control unit, configured to output the control signal to the audio processing unit and to control the audio processing unit to stop the output of the transmitted audio signals when a detection result of the length detection unit shows a length of the audio wire pulled out from the automatic reel is smaller than a predefined value.

2. The headphone system of claim 1, wherein the automatic reel comprises a button configured to trigger an elastic structure to roll up the audio wire automatically.

3. The headphone system of claim 1, wherein the control unit outputs the control signal to the audio processing unit, to control the audio processing unit to start operating, when a detection result of the length detection unit shows a length of the audio wire pulled out from the automatic reel is larger than a predefined value.

4. The headphone system of claim 3, wherein the control unit is further configured to control a speaker of the portable electronic device to stop operating.

5. The headphone system of claim 3, wherein the control unit is further configured to control a speaker of the portable electronic device to start operating.

6. A portable electronic device comprising:

an operating circuit; and a headphone system, configured to output sounds, comprising:

an audio wire, configured to transmit audio signals;

a sound output device, configured to receive and demonstrate the audio signals transmitted by the audio wire;

an audio processing unit, configured to receive audio data outputted by the operating circuit and output the transmitted audio signals corresponding to the received audio data via the audio wire according to a control signal;

an automatic reel, wound around an axis of the automatic reel by the audio wire and configured to roll up the audio wire around the axis of the automatic reel;

a length detection unit, configured to detect a rotating distance and a rotating direction of the automatic reel by synchronously rotating along the axis of the automatic reel when rolling up the audio wire; and a control unit, configured to output the control signal to the audio processing unit and to control the audio processing unit to stop the output of the transmitted audio signals when a detection result of the length detection unit shows a length of the audio wire pulled out from the automatic reel is smaller than a predefined value.

7. The portable electronic device of claim 6, wherein the automatic reel comprises a button configured to trigger an elastic structure to roll up the audio wire automatically.

8. The portable electronic device of claim 6, wherein the control unit outputs the control signal to the audio processing unit, to control the audio processing unit to start operating, when a detection result of the length detection unit shows a length of the audio wire pulled out from the automatic reel is larger than a predefined value.

9. The portable electronic device of claim 8, wherein the portable electronic device further comprises a speaker, and the control unit is further configured to control the speaker of the portable electronic device to stop operating.

10. The portable electronic device of claim 8, wherein the portable electronic device further comprises a speaker, and the control unit is further configured to control the speaker of the portable electronic device to start operating.

* * * * *